United States Patent [19]

Orfitelli

[11] Patent Number: 4,580,411

[45] Date of Patent: Apr. 8, 1986

[54] LIQUID NITROGEN FREEZER

[76] Inventor: James S. Orfitelli, 21 Warren St., Manchester, Conn. 06040

[21] Appl. No.: 717,527

[22] Filed: Apr. 1, 1985

[51] Int. Cl.[4] ..... F25D 3/08

[52] U.S. Cl. ..... 62/371; 62/382; 62/457; 62/514 R

[58] Field of Search ..... 62/371, 457, 382, 514 R

[56] References Cited

U.S. PATENT DOCUMENTS

| | | | |
|---|---|---|---|
| 3,257,820 | 6/1966 | Case et al. | 62/514 R |
| 3,633,381 | 1/1972 | Haaf | 62/514 R |
| 3,693,371 | 9/1972 | Clark | 62/514 R |
| 3,820,352 | 6/1974 | Mahler | 62/514 R |
| 4,026,351 | 5/1977 | Biava | 62/371 |
| 4,054,037 | 10/1977 | Yoder | 62/371 |

*Primary Examiner*—Ronald C. Capossela

[57] ABSTRACT

A portable compact liquified gas refrigeration system and apparatus comprising a freezer housing, a liquid delivery system, a liner and a tray means. The freezer housing is constructed for being relatively light weight and having an interior cavity, a sloped door opening, rear venting ports, and a bottom wall member. The liner includes a plurality of elongate parallel tray support rails or tracks. The liquid delivery system includes a manifold within said cavity and a valve mechanism for controlling the flow of liquified gas to the manifold. The liner has a sloped end wall to facilitate tray removal from the freezer housing. The tray has a plurality of holes to enable liquified gas transference or flow between the tray and the liner.

11 Claims, 7 Drawing Figures

LIQUID NITROGEN FREEZER

FIELD OF THE INVENTION

The present invention relates to a method and apparatus for quick freezing or refrigerating small items and food products and, more particularly, to a portable compact, liquified gas freezer for the production of ice cream forms, chocolate forms, confectionary forms and the like.

BACKGROUND OF THE INVENTION

In the preparation of various specialty forms of ice cream, chocolate and other food products, a conventional freezer unit having a compressor is typically utilized to freeze or make firm the food product to facilitate forming to a desired configuration or to solidify/freeze the food product in the (molded) form. Typically, such freezer units are relatively expensive, require substantial space, are expensive to operate and the freezing process requires a relatively long period. This relative long freeze period, in turn, delays production and therefore increases the unit cost of production. Other disadvantages of the prior art freezer units are that they are relatively complicated, are not compact, generally are sumptuous in component parts, are cumbersome in design and are expensive to manufacture and must be constructed or affixed in a dedicated area of the production (shop, store or plant) site.

Thus, it should be recognized that for a long time hitherto there has existed an unresolved need for an inexpensive, easy, quick and compact means for fast freezing ice cream speciality forms and the like during production of such items, and to enable convenient location of the freezer unit proximate to the site of production, and to enable convenient storage of the freezer unit in a readily accessible, for example, shelf or table, location during periods when such specialty items are not in production.

PRIOR ART STATEMENT

In one prior art system, such as is described in U.S. Pat. No. 3,287,925 issued Nov. 29, 1966 to J. J. Kane et al, an in transit liquified gas large refrigeration system for use in trucks is provided. The described system utilizes many valves, a pneumatic temperature indicator, several switch devices, a locator light, a run pilot light and complex control means, for example, see FIGS. 1-4.

Another prior art device, described in U.S. Pat. No. 3,100,971 issued Aug. 20, 1963 to W. L. Morrison, appears to describe a large freezer unit having a compartment containing mountable hooks to carry carcasses of meat.

Another prior art device, described in U.S. Pat. No. 3,092,974 issued June 11, 1963 to W. Haumann et al, appears to describe a method and apparatus for controlled freezing of biologicals.

These patents are mentioned as being representative of the prior art and other pertinent references may exist. None of the above cited patents are deemed to affect the patentability of the present claimed invention.

The present invention involves a novel combination of features combined in such a way as to afford a solution to the difficulties and disadvantages of the prior art devices while meeting many long felt and unresolved needs of the art field.

For example, in contrast to the prior art, the present invention provides a compact manually transportable liquified gas refrigeration system which is relatively inexpensive to manufacture, has virtually no installation costs, is adapted for ease of use at the local production site, enables relatively quick freezing, has a freezer compartment, a liner and a tray means adapted to economically utilized the liquified gas, has a sloped opening and tray to facilitate insertion and removal of the tray means, has a door means which is generally gravity held in a closed state, is robust and involves a minimum of associated parts.

SUMMARY OF THE INVENTION

A freezer having particular utility for quick freezing specialty/novelty ice cream forms, confectionary or other types of food items and the like, as well as other applications such as metallurgical/metal working, or deflashing of rubber or plastic parts, toys or items or for various biological and pharmaceutical applications at a local production site or assembly line/table and for being readily manually transportable and configured for being easily set-aside when not being utilized thereby facilitating small plant operations, comprising:

a compact relatively light weight housing having an internal freezer cavity, a contoured opening extending from said cavity to without said housing, a door means pivotally or hinge mounted to said housing and a plurality of venting ports;

a liquid delivery/spray means for spraying the liquid nitrogen or other liquified gas into said freezer cavity;

a liner means having a plurality of parallel slide tracks and being mountable within said cavity for collecting the sprayed liquid nitrogen; and a tray means having a plurality of holes in its bottom and a sloped end wall portion to facilitate sliding engagement with a contoured or sloped wall portion of said liner means at the opening in said housing.

Accordingly, it is an object of the present invention to provide a new and improved freezer unit.

Another object of the present invention is to provide a compact relatively portable freezer device.

Another object of the present invention is to provide a liquified gas freezer being relatively light weight and dimensioned for being table mounted.

Another object of the present invention is to provide a liquified gas freezer having a tray which is adapted for being readily removed from and inserted into the freezer box.

Another object of the present invention is to provide a liquified gas freezer having a contoured freezer opening and door to facilitate table-top use.

Another object of the present invention is to provide a liquified gas freezer adapted to economically and efficiently utilize the liquified gas by collecting the sprayed liquified gas within a liner means disposed at the bottom of the freezer box cavity and to enable flow thereof to the tray to aid the spraying to quick freeze the food item placed on the tray.

BRIEF DESCRIPTION OF THE DRAWINGS

Other objects and advantages of the invention may be more clearly seen when viewed in conjunction with the accompanying drawings. Similar reference numerals refer to similar parts throughout.

DESCRIPTION OF THE PREFERRED EMBODIMENTS

Figure 1:
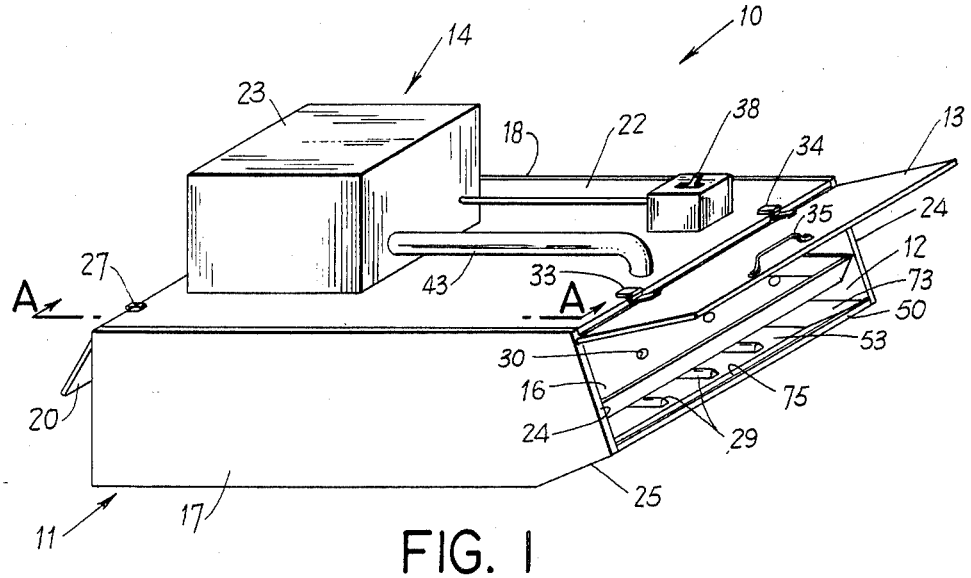
FIG. 1 is a perspective view of the freezer unit in accordance with the invention.
Figure 2:
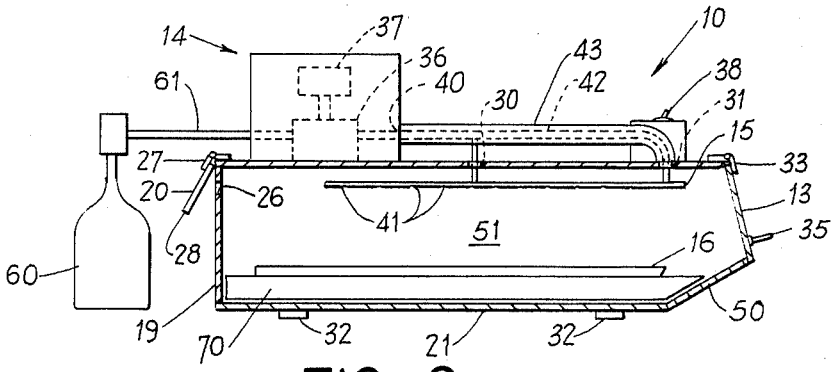
FIG. 2 is a side sectional view of FIG. 1 taken along A—A.
Figure 5:
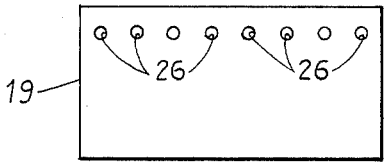
FIG. 5 is a plan view of the rear end wall of the freezer unit of FIG. 1 in accordance with the invention.

Referring to the drawings, particularly FIGS. 1–5, there is shown a liquified gas freezer unit 10 constructed in accordance with the invention to have a simple robust housing 11 with a contoured freezer door opening 12, a hinged door 13, a liquid flow control valve means 14, a manifold 15, and a discrete tray 16.

The housing 11 generally comprises a pair of side walls 17 and 18, a rear wall 19, a hood or shield 20, a bottom wall 21, a top wall 22, a lower sloped front wall 50 and an upper box like valve housing 23. The side walls 17 and 18 have a front upper outwardly sloping end portion 24 and a lower sloping end portion 25. The rear wall 19 has a generally rectangular shape with one or more gas venting holes 26. The hood 20 has a generally elongate rectangular shape and is cantilevered affixed by conventional means, for example, by means of brackets 27 or other suitable means, to have an outwardly sloping disposition with its lower edge 28 extending below the venting ports or holes 26. The bottom wall 21 has a flat rectangular shape. The top wall 22 is generally rectangularly shaped with a plurality of conduit holes 30 and 31 each extending into the internal freezer box or cavity 51 of housing 11.

Front wall 50 is affixed between respective portions of the lower sloping end portions 25 of side walls 17 and 18, and to an elongate front end wall portion of bottom wall 21 to form an outwardly sloping partial front wall member of housing 11. The constituent walls of housing 11 may be formed, for example, of a polyethylene or other suitable material.

Applicant has successfully operated the invention with the housing 11 being formed of a high density linear polyethylene known as ETH-R5200 available from the Chemical/Plastics Division of General Tire Corporation. The constituent walls of housing 11, in particular walls 17–19 and 21–22 and 50, may be formed from ¾ inch thick flat sections of such high density polyethylene. The walls may be affixed together in conventional manner, for example, with screws and the like, preferably to enable slight movement or shifting of or between the juxtaposed walls to accommodate any contraction and expansion effects thereon with the liquid nitrogen being periodically/selectively sprayed within the housing cavity.

A plurality of legs or nipples 32 may be provided on the bottom of housing 11.

Door 13 has a flat rectangular configuration and is mounted to top wall 22 in conventional manner, for example, by means of a pair of hinges 33 and 34. A handle 35 may be provided to facilitate opening and closing the freezer door 13. Door 13 may be constructed or formed of any suitable material such as ¾ inch thick high density polyethylene similar to that used to form the preferred embodiment of housing 11.

Flow control valve means 14 basically comprises a solenoid valve 36 and a timing relay 37 operatively connected to a manually actuatable switch 38 to control the flow of the liquid coolant, for example, liquid nitrogen, into the freezer box. Valve 36 has an inlet port 39 and an outlet port 40. Valve 36 is a normally closed type solenoid valve having an open state to enable fluid flow when energized. Timing relay 37 is electrically interconnected between valve 36 and switch 38, and functions to energize valve 36, i.e., cause it to turn "on" or assume its open state, for a predetermined time period with being energized by actuation of switch 38. Following this "on" or open state for the predetermined time period, for example, for approximately three or four seconds, timing relay 37 deenergizes valve 36 which then returns to its normally closed state. In this manner, a safeguard is provided against inadvertent excessive spraying, and a generally controlled approximate quantity of coolant (subject to flow rate pressure) is delivered to the freezer box cavity 51 with each actuation of switch means 38. The cycle "on" or open state time of valve 36 may be selectively predetermined or set for desired freezer application. The solenoid valve 36 and timing relay 37 may be of conventional design such as a solenoid valve designed to encounter cryogenic fluids available from Automatic Switch Co. of New Jersey, and an AGASTAT timing relay available from Amerage Corporation of New Jersey.

The manifold 15 basically comprises a cad/cam design aided serpentine conduit or pipe configuration and designed to effect an optimum or maximum spray or distribution area coverage, is mounted within freezer box cavity 51 to top wall 22. Manifold 15 contains a plurality of spray orifices or holes 41 and is connected to liquid conduit pipe 42 through one or more holes 30 and 31 in top wall 22. Liquid conduit pipe 42 is connected to outlet port 40 and may be coated 43 with an insulating material of conventional design. The size and quantity of spray holes 41 may be selected empirically. However, applicant found that with use of many such spray holes that no or virtually no flow restriction was presented thereby generally preventing an excessive pressure build up at or within manifold 15, while functioning satisfactorily. It should be noted at this time that many different arrangements and configurations of manifold 15 may be utilized in accordance with the invention.

Liner 70 (see FIGS. 1,2 and 4) has a rectangular shape generally comprising a bottom wall 71, side walls 72 and 73, a rear wall 74 and a sloped front wall 75. A plurality of parallel spaced tray support-slide tracks 29 are provided on bottom wall 71 and projects upwardly therefrom a predetermined height. Tray support-slide tracks 29 may be integrally formed with liner 70 or affixed to liner 70 in conventional manner. Liner 70 and tray support-slide tracks 29 may be formed of stainless steel or other suitable material. Liner 70 is dimensioned to fit within cavity 51 with its walls 71,72,73,74 and 75 being in close juxtaposition with housing walls 21,17,18,19 and 50, respectively.

Tray 16 has a rectangular configuration generally comprising a flat bottom wall 45, side walls 46 and 47, end wall 48 and a front wall 49, dimensioned for being inserted or received within liner 70. Front wall 49 may be sloped or configured for sliding engagement with liner 70 sloped front wall 74. Bottom wall 45 has a plurality of spaced holes 30 which function as a coolant drain and coolant conduit between the inner tray region, i.e., food transport surface 45, and the bottom container like area 53 of liner 70. In this manner, the sprayed liquified gas or liquid nitrogen may be drained-off and collected in the container like liner 70, prior to removal of tray 16 from freezer housing 11. It should also be appreciated that with collection of the liquid nitrogen in bottom area 53, a (new) food containing tray 16 may be exposed to the cooling effect of the collected liquid nitrogen to enhance the freezing process. preferably, slide tracks 29 have a sufficient height relative to the liquid nitrogen spray cycle to substantially prevent excessive collection, i.e., to a height above tracks 29, while the evaporation process is taking place. The tray 16 may be formed of any suitable material such as, for example, stainless steel.

Figure 6:
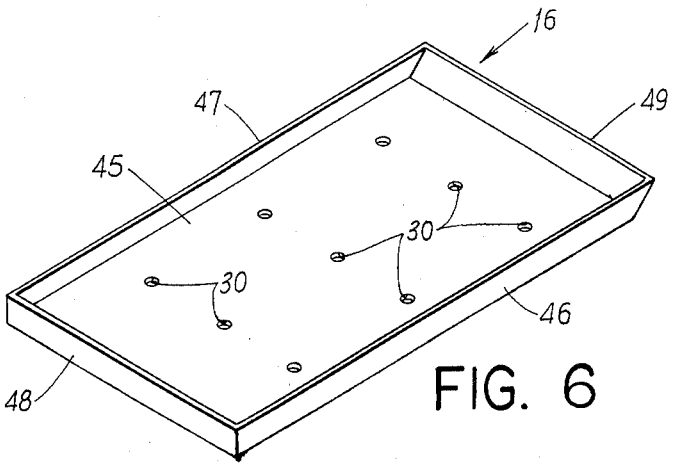
FIG. 6 is a perspective view of the tray in accordance with the invention.
Figure 7:
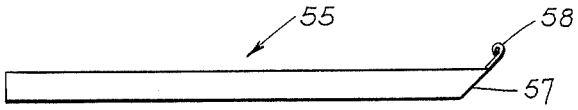
FIG. 7 is a side view of an alternative embodiment of the tray in accordance with the invention.
Figure 3:
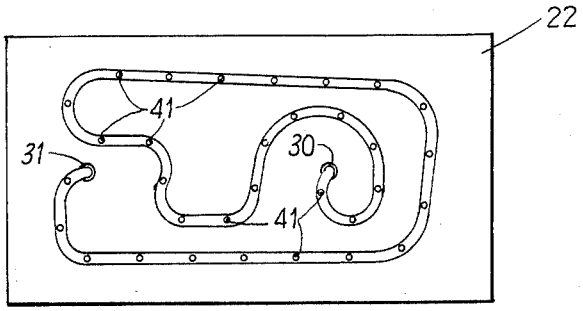
FIG. 3 is a plan view of the top wall of the housing and the perforated liquid gas conduit.
Figure 4:
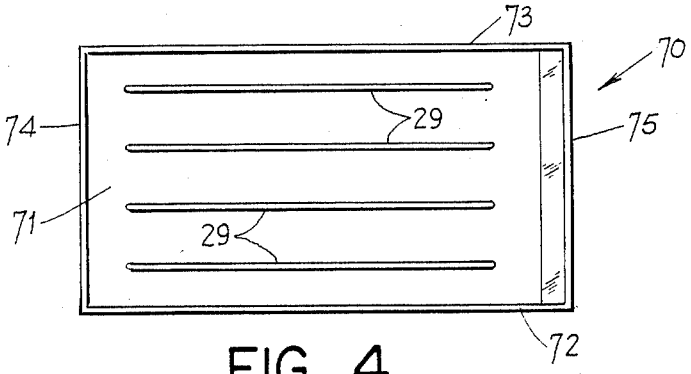
FIG. 4 is a top plan view of the liner in accordance with the invention.

With reference now to FIG. 7, an alternative embodiment of the tray 16 shown in FIG. 6 is illustrated. With the exception of alternative tray 55 the components and operation of freezer unit 10 remain basically the same.

Tray 55 also is provided with a sloped front wall 57 having an upper elongate curved or rolled or finger gripping member 58 to facilitate manual insertion and/or removal of tray 55 from the freezer box cavity and liner 70.

It should be recognized that liner 70 and tray 16 (or 55) are configured and dimensioned to enable easy removal from housing 11, for example, for cleaning etc.

OPERATION

Tray 16 (or 55) is removed from housing 11 and placed on a table where the selected, for example, ice cream sandwich form is placed on tray 16 (or 55) in conventional manner. Tray 16 (or 55) is then manually inserted into the freezer box cavity 51 and door 13 is closed. Next the operator switches switch 38 to its on position (not shown) which causes activation of timing relay 37. Timing relay 37, in turn, energizes solenoid valve 36 which then enables the flow of the pressurized liquid nitrogen from a liquid nitrogen source tank 60, via conduit pipe 61, through solenoid valve 36. The liquid nitrogen than flows from outlet port 40 through conduit pipe 42 and into manifold 15. Since this liquified gas coolant is under pressure, it is than sprayed from holes or nozzles 41 onto the ice cream forms thereby causing a relatively rapid freezing of the ice cream forms. In this manner, the soft ice cream is frozen for shipment or storage relatively quickly, efficiently and cost effectively.

When the specialty or novelty job is completed, which is typically only periodically performed by small to medium producers, the portable freezer unit 10 may be manually removed from the production area and placed on a table or shelf until the next specialty job or operation requires its use.

In this manner, a portable relatively inexpensive space saving freezer unit 10 is provided which effects relatively rapid freezing and, thereby, expedites production and shipping while minimizing prior art freezer storage requirements.

While there has been shown what is considered to be the preferred embodiment and an alternative embodiment of the invention, it is desired to secure in the appended claims all modifications as fall within the spirit and scope of the invention. For example, the tray means may also comprise many alternative embodiments such as a basket, a wire mesh like tray or basket, a rack, a plate or other open container means to facilitate placement of items to be forzen within the liquid nitrogen freezer in accordance with the invention.

I claim:

1. A compact and portable freezer which utilizes a liquid coolant such as liquid nitrogen, comprising:

housing means having an internal freezer cavity, and having wall portions defining a freezer opening extending from said freezer cavity to without said housing;

door means for selectively closing said freezer opening;

means being manually activatable for providing the liquid coolant into said freezer cavity;

tray means dimensioned for being insertable into said freezer cavity and having a rectangular configuration comprising a flat bottom wall, a pair of elongate side walls, an end wall and a front wall, said bottom wall has a plurality of spaced drain hole means to enable drainage and to expedite freezing with a collection of the liquid coolant within said freezer cavity; and means for supporting said tray means within said freezer cavity at a predetermined height.

2. A freezer as in claim 1, wherein:

the housing means has a generally rectangular configuration and dimensioned for being mountable on a table.

3. A freezer as in claim 1, including:

liner means having a plurality of elongate slide track means.

4. A freezer as in claim 1, wherein:

the housing means comprises a pair of side walls, a rear wall, a bottom wall, a top wall, a lower sloped front wall, and an upper box like valve housing, said side walls have a front upper outwardly sloping end portion and a lower sloping end portion, said rear wall has a generally rectangular shape with at least one vent hole.

5. A freezer as in claim 1, wherein:

the supporting means comprises a plurality of spaced slide tracks mounted on a discrete liner means dimensioned for being insertable within said freezer cavity and to enable said tray means to be disposed thereon.

6. A freezer as in claim 1, including:

liner means having a generally rectangular shape with a pair of side walls, an end wall, a sloped front wall and a bottom wall, said bottom wall having said means for supporting said tray means being integrally formed thereon, said liner being formed of stainless steel and dimensioned for being insertable into said freezer cavity and to enable said tray means to be placed on said supporting means.

7. A freezer as in claim 1, wherein:

the door means has a rectangular shape and is hinge mounted to said housing means such that in its closed position for being at a sloped angle.

8. A freezer as in claim 1, wherein:

the means for providing liquid coolant comprises a solenoid valve, a timing relay and a serpentine manifold having a plurality of spray orifices, said manifold is mounted within said freezer cavity and is connected to an outlet port of said solenoid valve, said solenoid valve has an inlet port being connectable to the liquid coolant, said timing relay is operatively connected to said solenoid valve and to a switch means for energizing said solenoid valve to an open state for a predetermined time period with each manual actuation of said switch means.

9. A freezer as in claim 1, wherein:

the tray means has rectangular configuration comprising a flat bottom wall, a pair of elongate side walls, an end wall and a front wall, said front wall is sloped and configured to facilitate manual manipulation and removal of said tray means from without said housing means, said bottom wall has a plurality of spaced drain holes.

10. A table top liquid nitrogen type freezer system for providing liquid nitrogen from a discrete source of liquid nitrogen onto an item, in combination comprising:

housing means (11) having a generally rectangular shape and dimensioned for being disposed atop a table, said housing having a pair of side walls (17,18), a rear wall (19), a bottom wall (21), a top wall (22), a lower sloped front wall (50), and an upper box like valve housing (23), said side walls have a front upper outwardly sloping end portion (24) and a lower sloping end portion (25), said rear wall has a generally rectangular shape with a plurality of vent holes (26), said housing means having an internal freezer box cavity (51) with a freexer opening (12) extending without said housing means defined by portions of said sloped front wall (50) and the front upper outwardly sloping end portions (24) of said side walls and said top wall;

door means (13) hinge (33,34) mounted to said top wall and being dimensioned for being disposed in a closed position with peripheral wall portions being in juxtaposition with the housing wall portions defining said freezer opening;

means for regulating the flow of the liquid nitrogen from the source of liquid nitrogen to the freezer box cavity, said regulating means having a solenoid valve (36), a timing relay means (37) operatively coupled to said solenoid valve, a serpentine configured manifold (15) having a plurality of liquid nitrogen spray nozzles (41), a first conduit (42) connecting said manifold to an outlet port (40) of said solenoid valve, a second conduit (61) connecting an inlet port (39) of said solenoid valve to the source of liquid nitrogen (60), a manually actuatable switch means (38) operatively coupled to said timing relay, and an insulating coating (43) about said first conduit;

liner means (70) having a generally rectangular shape with a bottom wall (71), a pair of side walls (72 and 73), a rear wall (74) a sloped front wall 75, and a plurality of spaced parallel elongate slide tracks (29);

tray means (16 or 55) having a generally rectangular shape with a flat bottom wall (45), a pair of side walls (46,47), a rear wall (48), and a sloped front wall (49 or 57), said bottom wall has a plurality of spaced drain holes (30); and a hood means (20) having a generally elongate rectangular shape being cantilevered mounted along an elongate wall edge to said top wall (20) to have an outwardly sloping disposition with its lower wall edge (28) extending downwardly below said vent holes (26);

whereby the liquid nitrogen freezer system being manually transportable to enable use at one or more selected positions with being mounted on a table top and for enabling relatively quick freezing of an item placed within said freezer box cavity with spraying of the liquid nitrogen within said freezer box cavity.

11. A table top liquid nitrogen type freezer system as in claim 10, wherein:

the housing means is formed of a ¾ inch or greater high density polyethylene to enable contraction and/or expansion of a portion of said housing means with temperature changes within said internal freezer box cavity;

the liner means is formed of stainless steel; and the tray means is formed of stainless steel and being dimensioned to generally fit within said liner means.

* * * * *